US007278881B1

(12) United States Patent
Lu

(10) Patent No.: US 7,278,881 B1
(45) Date of Patent: Oct. 9, 2007

(54) DETACHABLE ELECTRICAL CONNECTOR

(75) Inventor: Ching-Tung Lu, Banciao (TW)

(73) Assignee: Fen Ying Enterprises Co., Ltd., Banciao, Taipei County (TW)

( * ) Notice: Subject to any disclaimer, the term of this patent is extended or adjusted under 35 U.S.C. 154(b) by 0 days.

(21) Appl. No.: 11/724,183

(22) Filed: Mar. 15, 2007

(51) Int. Cl.
*H01R 13/60* (2006.01)

(52) U.S. Cl. ..... 439/541.5

(58) Field of Classification Search ..... 439/541.5, 439/676, 675
See application file for complete search history.

(56) References Cited

U.S. PATENT DOCUMENTS 6,776,651 B1 * 8/2004 Liu ..... 439/490
2004/0224564 A1 * 11/2004 Wan et al. ..... 439/676
2005/0032419 A1 * 2/2005 Kedem ..... 439/541.5
2006/0009072 A1 * 1/2006 Li ..... 439/541.5

* cited by examiner

*Primary Examiner*—Phuong Dinh
(74) *Attorney, Agent, or Firm*—Bacon & Thomas, PLLC

(57) ABSTRACT

The invention is to provide a detachable electrical connector, which comprises a seat having an upper first recess with a first connecting member disposed therein, a lower second recess adjacent the first recess and being in communication thereto, and a third recess besides the second recess with a second connecting member disposed therein, wherein the second recess is adapted to receive an attachment member which is capable of protecting a plurality of conductors and includes ridges for spacing any two adjacent first conductors for preventing a potential short circuit from occurring. Thus, the first and second connecting members are spaced from each other and facing different directions.

8 Claims, 5 Drawing Sheets

DETACHABLE ELECTRICAL CONNECTOR

FIELD OF THE INVENTION

The invention relates to electrical connectors and more particularly to a detachable electrical connector with improved characteristics.

BACKGROUND OF THE INVENTION

The availability of various electronic products is even faster as electronics and information technology make progress significantly in recent several decades throughout the world. For example, an additional connector is mounted on a motherboard of a computer such that either a new function can be added to the computer or the purpose of making the motherboard comply with new specifications is achieved. This is an important phase of designing a motherboard. An electrical connector (or connector in short) is a component for transmitting signals (i.e., data) or power from one electronic device to the other electronic device by connecting to a mated connector of the other electronic device. Thus, quality of a connector plays a critical role in signal transmission performance. And in turn, performance of the connected electronic device is closely associated therewith.

A conventional detachable electrical connector 1 is shown in FIG. 1. The electrical connector 1 comprises a seat 11 including a first recess 112, a second recess 113 opposite the first recess 112, a first connecting member 111 adjacent the second recess 113, a first latch 114 upright projecting from a blind end of the first connecting member 111, and a plurality of bent conductors 115 extended from a bottom end of the first latch 114 to the first connecting member 111. The conductors 115 in turn pass the bottom of the first connecting member 111 and the first recess 112 to project out of the seat 11 in a direction away from the first latch 114.

The electrical connector 1 further comprises an attachment member 13 mounted onto the first recess 112 for protecting the conductors 115; a second connecting member 14 mounted in the second recess 113 and including a plurality of slots 141; an abutment member 12 mounted on a top of the seat 11, the abutment member 12 including a second latch 121 mated with the first latch 114 and secured thereto such that the first connecting member 111 is capable of connecting to and fastening a connector of a peripheral device when the abutment member 12 is secured onto the seat 11; a first casing 15 of L-section mounted onto the seat 11 wit both the abutment member 12 and the attachment member 13 enclosed therein; and a second casing 16 of U-section opposite the first casing 15 and facing both the second connecting member 14 and the first connecting member 111, the second casing 16 including a plurality of openings 151 facing both the second connecting member 14 and the first connecting member 111.

However, the well known detachable electrical connector suffered from several disadvantages in installation and use. For example, as shown in FIG. 1 again, the first connecting member 111 is formed on the seat 11 of the detachable electrical connector 1. However, the whole detachable electrical connector 1 is no longer useful if only the first connecting member 111 is damaged.

Moreover, as shown in FIG. 1 again the function of the first connecting member 111 connecting to and fastening a connector of a peripheral device is effected only when the abutment member 12 is secured onto the seat 11. However, the fastening of the abutment member 12 and seat 11 is reliable. Hence, either the abutment member 12 or the seat 11 is prone to damaging when plugging or unplugging the connector of the peripheral device. This really bothers users a lot and causes a great inconvenience in use.

In addition, as shown in FIG. 2, both the slots 141 and the first connecting member 111 face the same direction. But it is understood that the connector of the peripheral device is not required to plug or unplug frequently. In fact, it is often that the connector of the peripheral device is maintained in its insertion into the detachable electrical connector 1 for a relatively long period of time. It is possible that the inserted connector of the peripheral device is disengaged with the slots 141 or the first connecting member 111 when either connecting the connector of the peripheral device to the slots 141 and the first connecting member 111 or unplugging the connector of the peripheral device out of the slots 141 and the first connecting member 111. As a result, data transmission through the connected connectors fails. This indeed bothers users and causes a great inconvenience in use. Thus, continuing improvements in the exploitation of detachable electrical connector without the well known disadvantages described above by having beneficial features including convenient use and reliability are constantly being sought among detachable electrical connector manufacturers of the art.

SUMMARY OF THE INVENTION

After considerable research and experimentation, a detachable electrical connector according to the invention has been devised so as to overcome the above drawbacks of the prior art.

It is an object of the invention to provide a detachable electrical connector comprising a seat including an upper first recess with a first connecting member disposed therein, a lower second recess adjacent the first recess and being in communication thereto, the second recess adapted to receive an attachment member which is capable of protecting a plurality of conductors and spacing any two adjacent first conductors for preventing a potential short circuit from occurring, and a third recess besides the second recess with a second connecting member disposed therein. Thus, the first and second connecting members are spaced from each other facing different directions. By utilizing the detachable electrical connector the drawbacks of the well known detachable electrical connector are eliminated. These drawbacks include, for example, the inserted connector of the peripheral device being prone to undesirably disengaging with the first connecting member when either connecting the connector of the peripheral device to the first connecting member or unplugging the connector of the peripheral device out of the first connecting member.

The above and other objects, features and advantages of the invention will become apparent from the following detailed description taken with the accompanying drawings.

DETAILED DESCRIPTION OF THE PREFERRED EMBODIMENTS

Figure 1:
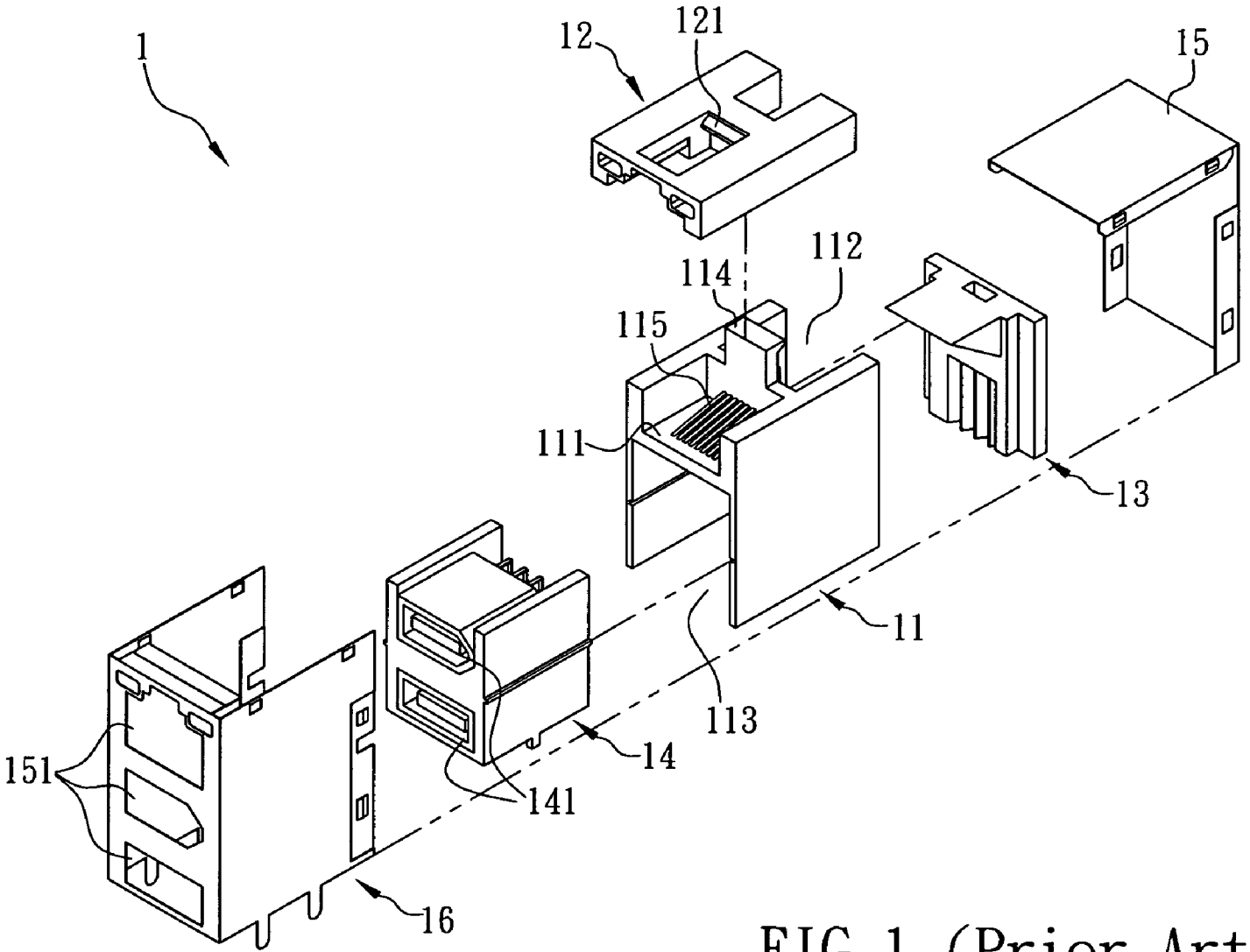
FIG. 1 (Prior Art)
FIG. 1 is an exploded view of a conventional detachable electrical connector.
Figure 2:
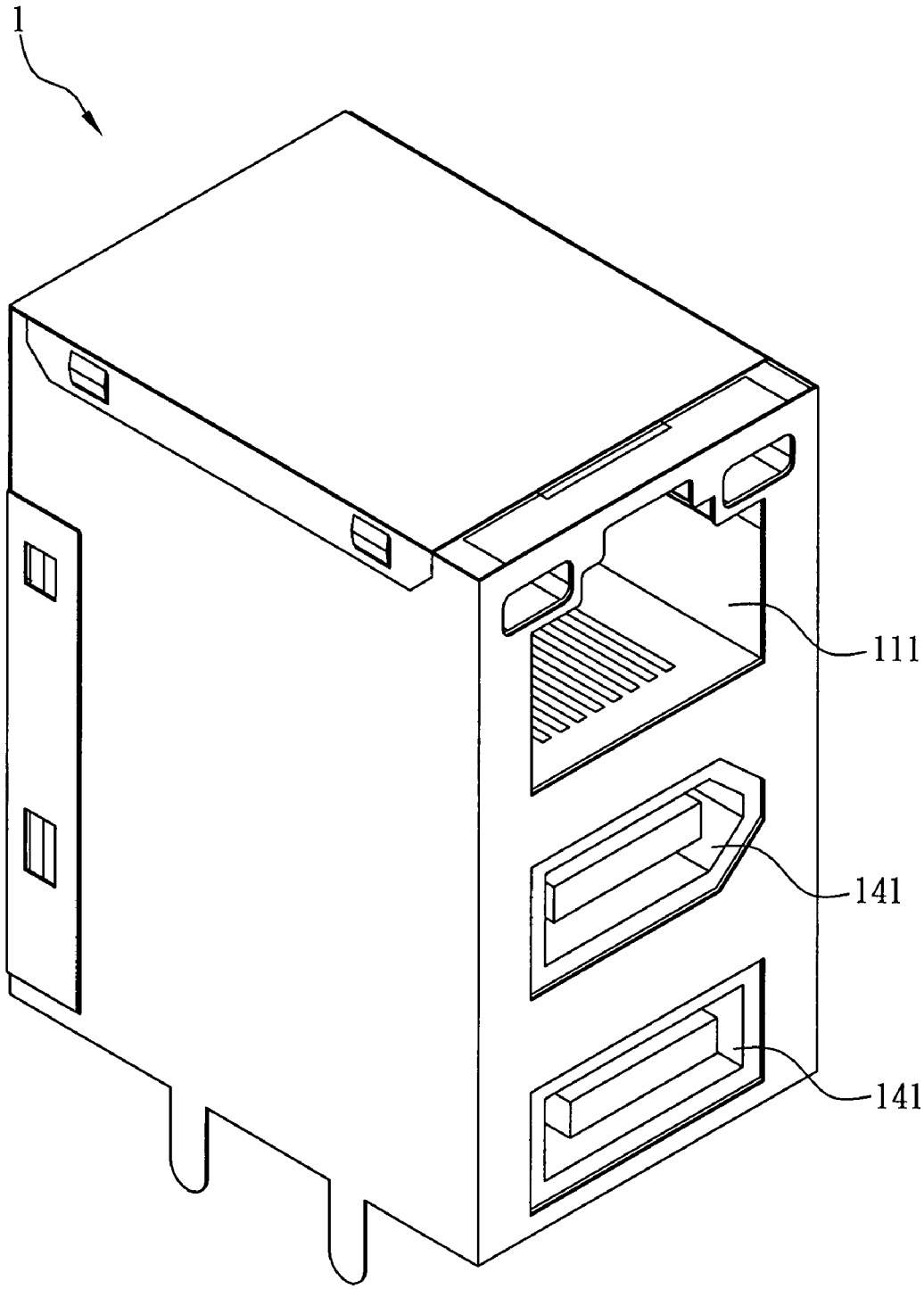
FIG. 2 (Prior Art)
FIG. 2 is a perspective view of the assembled electrical connector.
Figure 3:
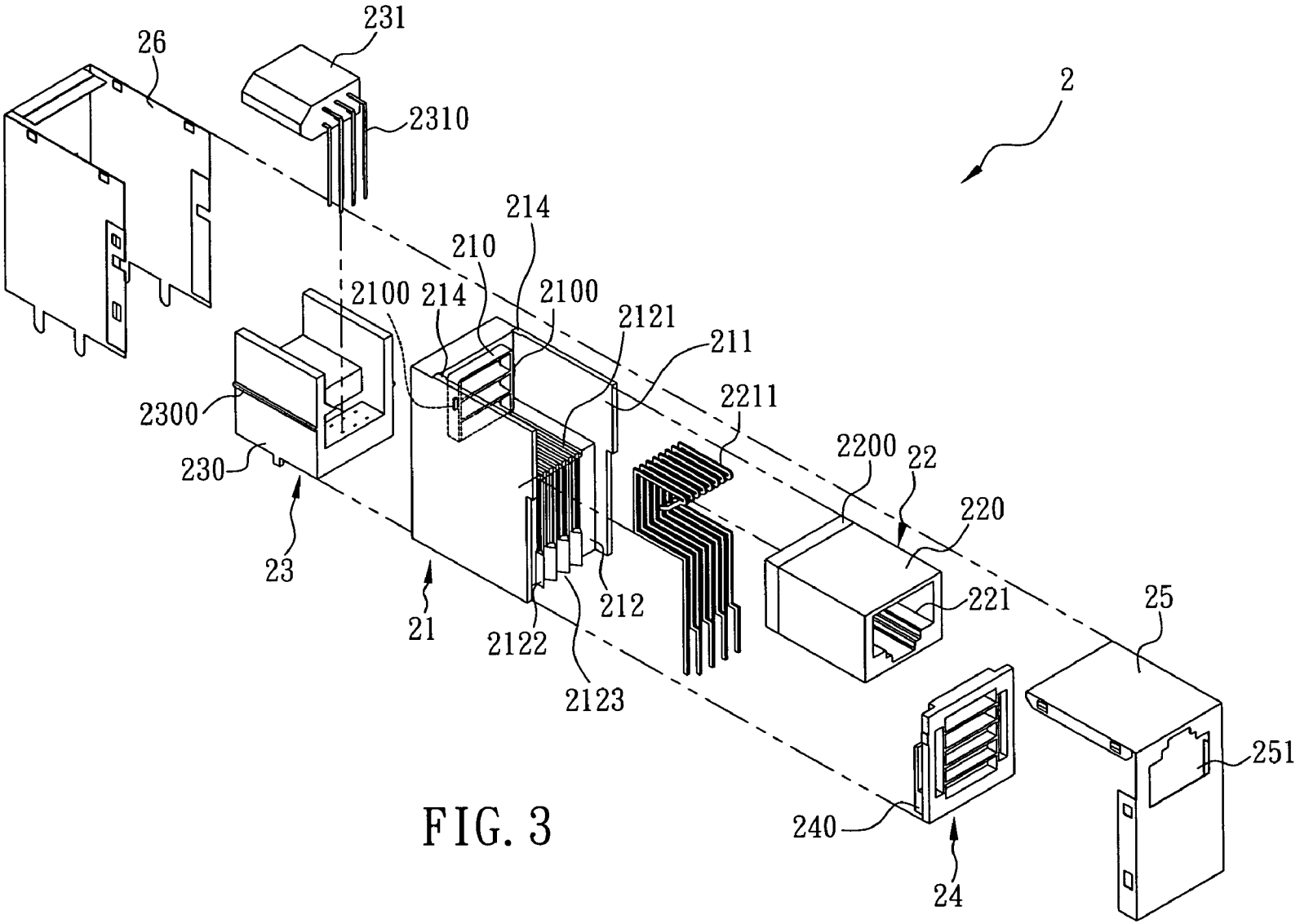
FIG. 3 is an exploded view of a preferred embodiment of detachable electrical connector according to the invention.

Referring to FIG. 3, a detachable electrical connector 2 in accordance with a preferred embodiment of the invention is shown. The detachable electrical connector 2 comprises a seat 21; a front first connecting member 22, and a rear second connecting member 23. The connecting members 22 and 23 are mounted in the seat 21 and are also spaced from each other facing different directions. For example, a connector of one peripheral device is adapted to connect to the first connecting member 22 in the assembled electrical connector 2. Thus, it is highly impossible of inserting a connector of the other peripheral device into the wrong connecting member (e.g., the first connecting member 22 in this case) in a plugging operation. Further, it is highly impossible of inadvertently pulling the wrong connector out of either connecting member in an unplugging operation. As a result, an inadvertent pulling of the connector of the peripheral device out of either connecting member is substantially avoided.

Figure 4:
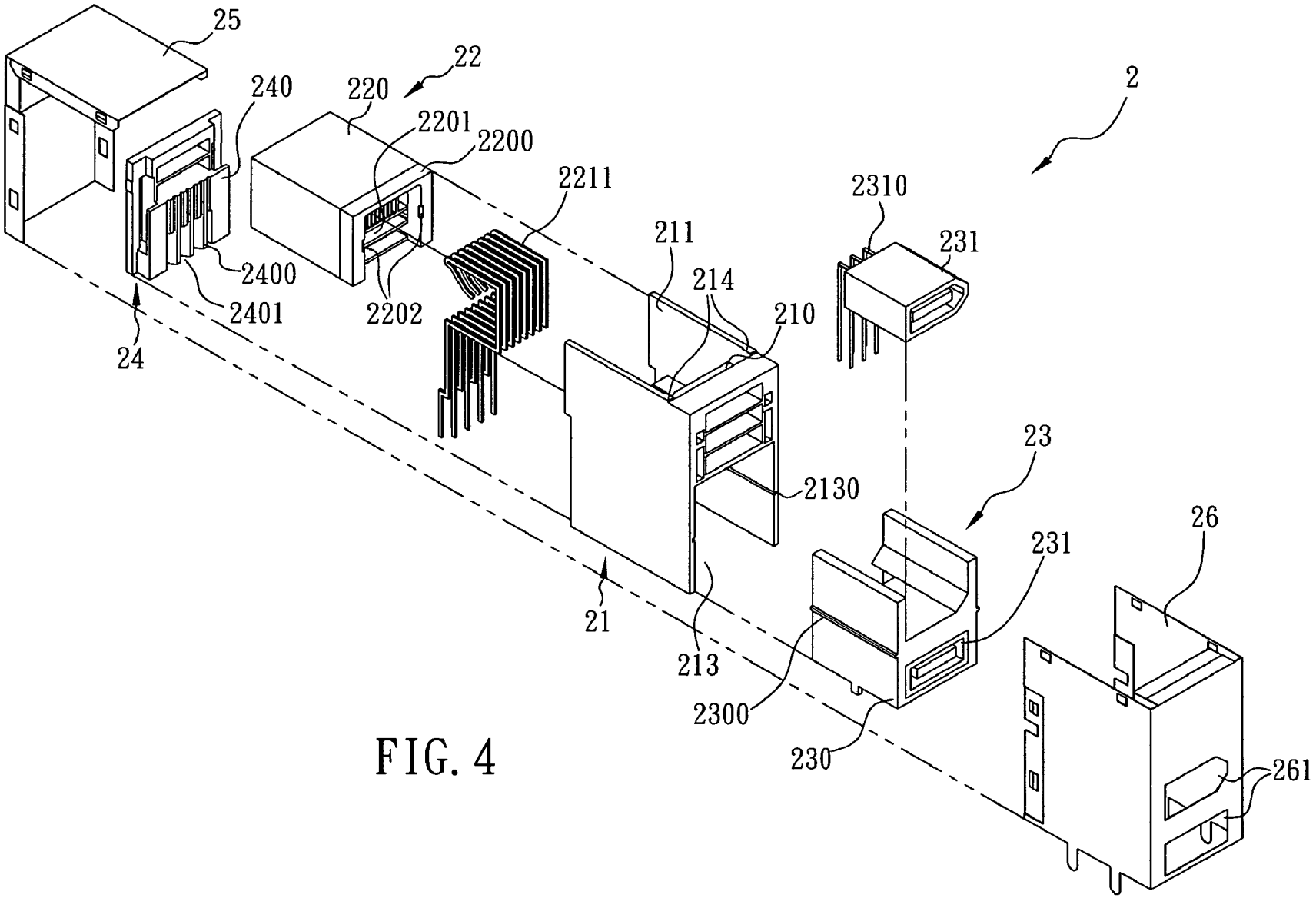
FIG. 4 is a view similar to FIG. 3 but viewed from an opposite angle.

Referring to FIG. 4 in conjunction with FIG. 3, in the preferred embodiment of the invention the rectangular seat 21 comprises an upper first recess 211, two retaining members 214 provided in two top corners of a rear wall of the first recess 211 respectively, the retaining members 214 extended toward the first recess 211, a lower second recess 212 adjacent the first recess 211 and being in communication thereto, a lower third recess 213 besides the second recess 212, an upper protrusion 210 slightly projecting into the first recess 211, and a hole 2100 provided at either side of the protrusion 210 facing the first recess 211. The first connecting member 22 is adapted to mount in the first recess 211.

Referring to FIGS. 3 and 4 again, in the preferred embodiment of the invention the rectangular first connecting member 22 comprises a first housing 220 including an inverted U-shaped flange 2200 projecting from a rear end of the first housing 220 into the seat 21 to urge against the retaining members 214, a rear fourth recess 2201 facing the protrusion 210, and a tab 2202 provided at either side of the fourth recess 2201, the tabs 2202 adapted to secure to the holes 2100 by inserting therein. Moreover, a first receptacle 221 is formed in the first housing 220. A plurality of first conductors 2211 are provided and are adapted to partially dispose in the first receptacle 221. In detail, the bent first conductors 2211 extend from the first receptacle 221 into the seat 21. Next, the first conductors 2211 pass a bottom of the first recess 211 into the second recess 212. Finally, the first conductors 2211 extend out of the seat 21 in a direction away from the first connecting member 22. For repairing the malfunctioned first connecting member 22, a person may simply detach the first connecting member 22 from the first recess 211 and then mount a new first connecting member 22 in the first recess 211 instead of replacing the whole electrical connector 2 with a new one. Moreover, the first housing 220 of the first connecting member 22 is an integral member. Hence, the structural strength of the first housing 220 is higher than that of a first housing 220 formed by assembling a number of components.

Referring to FIGS. 3 and 4 again, in the embodiment a plurality of parallel first troughs 2121 are formed and defined by the second recess 212, the first recess 211, and one side of the seat 21. A plurality of parallel lower rear first ridges 2122 are formed and defined by the second recess 212, one side of the seat 21, a bottom of the seat 21, and a bottom of the first troughs 2121. A second trough 2123 is formed between any two adjacent first ridges 2122. An attachment member 24 is provided in the second recess 212. The attachment member 24 comprises a rear first engagement element 240 facing the seat 21. The first engagement element 240 comprises a plurality of parallel third troughs 2401 in communication with the bottom of the seat 21. A second ridge 2400 is formed between any two adjacent third troughs 2401. Each of the second ridges 2400 is adapted to insert into a dip between any two adjacent second troughs 2123. A space is formed between a top of the second ridges 2400 and a bottom of the second troughs 2123 for disposing a portion of the first conductors 2211. Moreover, each of the first ridges 2122 is adapted to insert into a dip between any two adjacent third troughs 2401. A space is formed between a top of the first ridges 2122 and a bottom of the third troughs 2401 for disposing another portion of the first conductors 2211. The attachment member 24 can protect the first conductors 2211 when a portion of the first conductors 2211 is received in the second recess 212. Further, any two adjacent first conductors 2211 are spaced by the ridges 2122 and 2400 and the troughs 2121, 2123, and 2401. As a result, a potential short circuit is prevented from occurring.

Referring to FIGS. 3 and 4 again, in the embodiment a groove 2130 is formed on an inner surface of either side of the third recess 213 of the seat 21. The second connecting member 23 is adapted to mount in the third recess 213. The second connecting member 23 comprises a second housing 230. A projecting rail 2300 is formed on an outer surface of either side of the second housing 230. The rails 2300 are adapted to align with and slidably mount in the grooves 2130. A second receptacle 231 is provided in the second housing 230. A plurality of second conductors 2310 are provided and are adapted to partially dispose in the second receptacle 231. In detail, the bent second conductors 2310 extend out of the second housing 230. The shown second receptacle 231 can be replaced by another type of receptacle depending on applications. For repairing the malfunctioned second receptacle 231, a person may simply detach the second receptacle 231 from the third recess 213 and then mount a new second receptacle 231 in the third recess 213 instead of replacing the whole electrical connector 2 with a new one.

Referring to FIGS. 3 and 4 again, in the embodiment a first casing 25 of L-section is provided and mounted onto the seat 21 with both the first connecting member 22 and the attachment member 24 enclosed therein. The first casing 25 comprises a front first opening 251 aligned with the first receptacle 221. A rear second casing 26 of U-section is provided and mounted onto two sides of the seat 21 with the second connecting member 23 is received therein. Both sides of the second casing 26 are matingly assembled with the first casing 25. Also, the first receptacle 22 has its both side surfaces proximate both sides of the assembled first and second casings 25 and 26. The second casing 26 comprises a plurality of second openings 261 facing the second receptacle 31.

Figure 5:
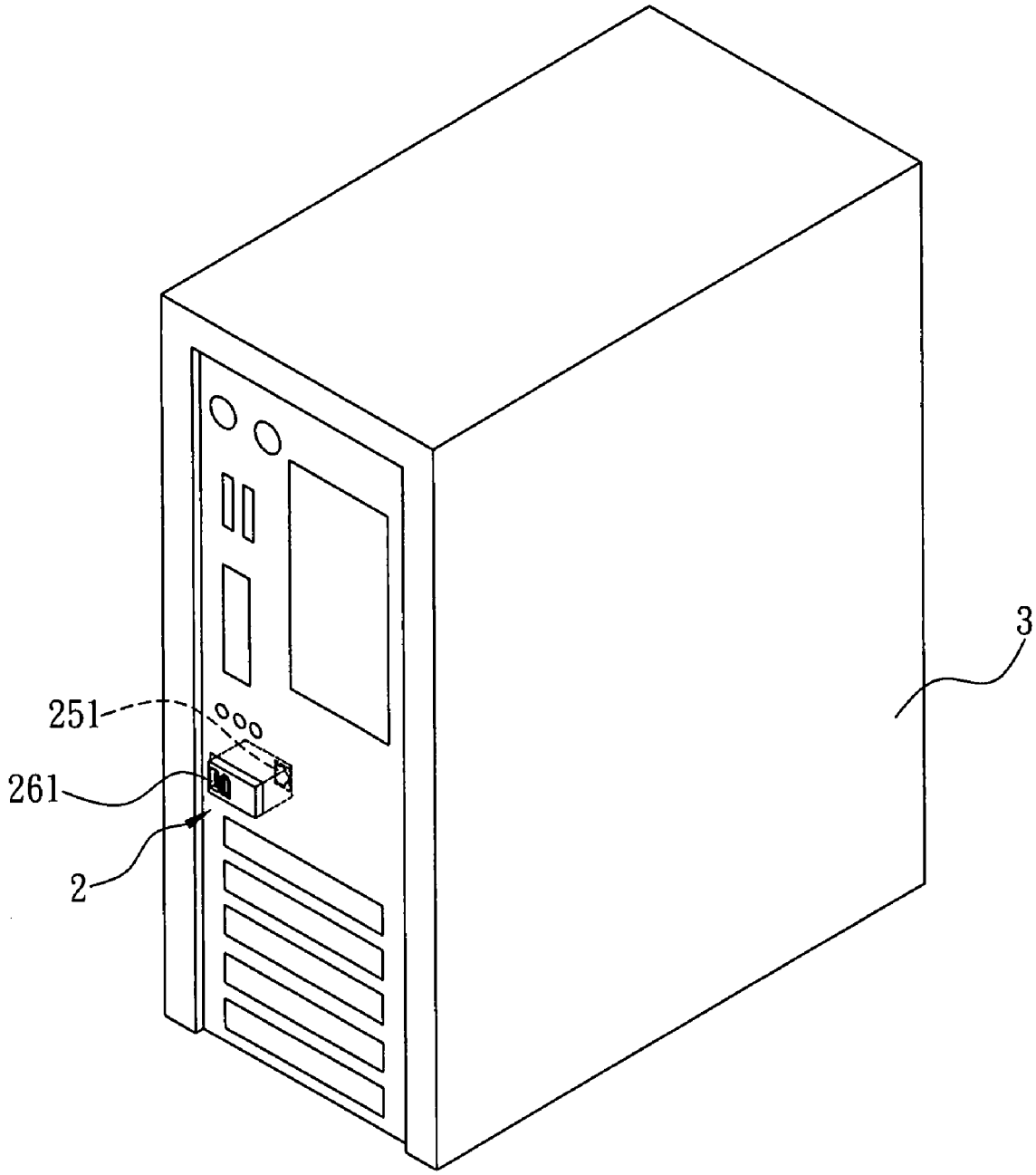
FIG. 5 is an environmental view of the assembled electrical connector of the invention mounted on a rear panel of a computer case.

Referring to FIG. 5 in conjunction with FIG. 4, in the embodiment the openings 251 and 261 are formed oppositely on the electrical connector 2. Only a rear portion of the electrical connector 2 is exposed when the electrical connector 2 is mounted on a rear panel of an electrical device (e.g., a personal computer as shown) 3. In brief, either the first opening 251 to be electrically connected to a connector of a peripheral device is exposed or the second openings 261 to be electrically connected to the connector of the peripheral device are exposed in use. This can prevent either an insertion of the connector of the peripheral device into the wrong opening or a wrong pulling of the connector of the peripheral device out of the opening from occurring. As such, it is very convenient in use. Moreover, it is a fault proof design since only the opening(s) to be electrically connected to the connector of the peripheral device is (are) exposed rather than exposing the other opening(s) hidden in the electrical device 3. As a result, a loosening of the inserted connector of the peripheral device by inadvertently unplugging same is prevented from occurring.

While the invention herein disclosed has been described by means of specific embodiments, numerous modifications and variations could be made thereto by those skilled in the art without departing from the scope and spirit of the invention set forth in the claims.

What is claimed is:

1. A detachable electrical connector comprising:

a seat including an upper first recess, a lower second recess adjacent the first recess and being in communication thereto, and a lower third recess besides the second recess;

a first connecting member including a first housing disposed in the first recess, at least one first receptacle formed in the first housing, and a plurality of first conductors partially disposed in the first receptacle, wherein the first conductors are bent to extend through a bottom of the first recess and the second recess and out of the seat;

a second connecting member including a second housing disposed in the third recess, at least one second receptacle formed in the second housing, and a plurality of second conductors partially disposed in the second receptacle, wherein the second conductors are bent to extend out of the seat; and an attachment member disposed in the second recess, wherein the first conductors of the first connecting member are spaced apart by spacing means on the attachment member and spacing means on the seat.

2. The detachable electrical connector of claim 1, further comprising a plurality of parallel first projections formed and defined by the second recess, the first recess, and one side of the seat, a plurality of first troughs each formed between any two adjacent ones of the first projections, a plurality of parallel second projections formed and defined by the second recess, one side of the seat, a bottom of the seat, and a bottom of the first troughs, and a plurality of second troughs each formed between any two adjacent ones of the second projections.

3. The detachable electrical connector of claim 2, wherein the attachment member comprises a first engagement element facing the seat, the first engagement element including a plurality of parallel third troughs in communication with the bottom of the seat, and a plurality of parallel third projections each formed between any two adjacent ones of the third troughs, each of the third projections adapted to insert into a dip between any two adjacent ones of the second troughs, wherein a first space is formed between a top of the third projections and a bottom of the second troughs, wherein each of the second projections is adapted to insert into a dip between any two adjacent ones of the third troughs, and wherein a second space is formed between a top of the second projections and a bottom of the third troughs.

4. The detachable electrical connector of claim 1, wherein the first housing comprises a peripheral flange projected into the seat, wherein the seat further comprises two retaining members formed on two top corners of the first recess and extended toward the first recess respectively, and wherein the flange urges against the retaining members.

5. The detachable electrical connector of claim 4, wherein the seat further comprises a protrusion projected into the first recess, and a first latching member disposed at either side of the protrusion, wherein the first connecting member further comprises a fourth recess facing the protrusion, and a mated second latching member disposed at either side of the fourth recess and adapted to secure to the first latching member by inserting therein.

6. The detachable electrical connector of claim 1, further comprising a groove formed on an inner surface of either side of the third recess of the seat, and a projecting rail formed on an outer surface of either side of the second housing, the rails adapted to slidably mount in the grooves.

7. The detachable electrical connector of claim 1, further comprising a first casing adapted to mount onto the seat with the first connecting member and the attachment member received therein, the first casing including at least one first opening aligned with the first receptacle.

8. The detachable electrical connector of claim 7, further comprising a second casing adapted to mount onto two sides of the seat with the second connecting member received therein, the second casing having both sides matingly assembled with the first casing with the first receptacle having both sides proximate the sides of the assembled first and second casings, wherein the second casing includes at least one second opening facing the second receptacle.

* * * * *